US006892877B2

(12) United States Patent
Shurman

(10) Patent No.: US 6,892,877 B2
(45) Date of Patent: May 17, 2005

(54) DISPENSING CONTAINER

(75) Inventor: Anthony Craig Shurman, New York, NY (US)

(73) Assignee: Yosh! Enterprises, Westfield, NJ (US)

( * ) Notice: Subject to any disclaimer, the term of this patent is extended or adjusted under 35 U.S.C. 154(b) by 0 days.

(21) Appl. No.: 09/935,142

(22) Filed: Aug. 21, 2001

(65) Prior Publication Data

US 2003/0038048 A1 Feb. 27, 2003

(51) Int. Cl.[7] ..... B65D 69/00
(52) U.S. Cl. ..... 206/236; 206/242; 206/800
(58) Field of Search ..... 131/329; 206/87, 206/443, 242, 38, 236, 86, 95, 81, 800, 37; 220/254.2, 254.3

(56) References Cited

U.S. PATENT DOCUMENTS

| | | | | | |
|---|---|---|---|---|---|
| 724,667 | A | * | 4/1903 | Cornell | 206/236 |
| 2,727,547 | A | * | 12/1955 | Moon | 206/38 |
| 2,809,747 | A | * | 10/1957 | Fowler | 206/95 |
| 3,472,362 | A | * | 10/1969 | Shinoda | 206/86 |
| 3,915,295 | A | | 10/1975 | Morrison | |
| 4,046,252 | A | * | 9/1977 | Korby et al. | 206/236 |
| 4,144,985 | A | * | 3/1979 | Kinslow | 220/254.3 |
| 4,517,994 | A | * | 5/1985 | Endelson | 206/87 |
| 4,538,731 | A | * | 9/1985 | Cillario | 220/254.3 |
| 4,804,113 | A | * | 2/1989 | Ciaccio | 220/254.2 |
| 4,852,729 | A | | 8/1989 | Conte | |
| 4,989,728 | A | | 2/1991 | Neyret et al. | |
| 5,088,684 | A | | 2/1992 | Torras et al. | |
| 5,096,057 | A | | 3/1992 | Yoo | |
| 5,353,956 | A | * | 10/1994 | Wilson | 206/800 |
| 5,482,157 | A | | 1/1996 | Kim | |
| 5,558,217 | A | | 9/1996 | Focke et al. | |
| 5,630,503 | A | | 5/1997 | Rhodes et al. | |
| 5,636,732 | A | * | 6/1997 | Gilels et al. | 206/800 |
| 5,878,875 | A | | 3/1999 | Leong | |
| 5,918,734 | A | | 7/1999 | Devens et al. | |
| 6,119,852 | A | | 9/2000 | Focke et al. | |
| D432,263 | S | | 10/2000 | Issa | |
| 6,223,891 | B1 | | 5/2001 | Devens et al. | |

OTHER PUBLICATIONS (front view) "Breath Savers Cool Blasts", Nabisco Inc.
(back view) "Breath Savers Cool Blasts", Nabisco Inc.
(side view) "Breath Savers Cool Blasts", Nabisco Inc.
(front view) "Certs Powerful Mints", 1996, Warner–Lambert Co.
(back view) "Certs Powerful Mints", 1996, Warner–Lambert Co.

(Continued)

*Primary Examiner*—Luan K. Bui
(74) *Attorney, Agent, or Firm*—Baker & McKenzie

(57) ABSTRACT

A dispensing container for dispensing confectionary items. The dispensing container includes a body having a chamber for storing confectionary items and a door connected to the body and operable to dispense the confectionary items stored in the chamber. The body also includes a top portion, the top portion including the door, and a bottom portion having a tapered edge adapted to be inserted into a tight location, for example, between a wrapper of a cigarette package and the cigarette package. The dispensing container can have dimensions such that a flip top of the cigarette package can be opened and cigarettes can be extracted and/or the confectionary items can be extracted from the chamber while the dispensing container is inserted between the wrapper and the cigarette package.

38 Claims, 5 Drawing Sheets

OTHER PUBLICATIONS (side view) "Certs Powerful Mints", 1996, Warner–Lambert Co.
(front view) "Café Select After Coffee Mints", 2002, Ovalette Brands LLC.
(back view) "Café Select After Coffee Mints", 2002, Ovalette Brands LLC.
(side view) "Café Select After Coffee Mints", 2002, Ovalette Brands LLC.
(front view) "Winterfresh Thin Ice", 2002, Wm. Wrigley Jr. Company.
(back view) "Winterfresh Thin Ice", 2002, Wm. Wrigley Jr. Company.
(side view) "Winterfresh Thin Ice", 2002, Wm. Wrigley Jr. Company.
(front view) "Cool Mint Listerine PocketPaks", 2001, Pfizer.
(back view) "Cool Mint Listerine PocketPaks", 2001, Pfizer.
(side view) "Cool Mint Listerine PocketPaks", 2001, Pfizer.
(front view) "Myntz! Instastripz", 2001, Myntz! Brands.
(back view) "Myntz! Instastripz", 2001, Myntz! Brands.
(side view) "Myntz! Instastripz", 2001, Myntz! Brands.

* cited by examiner

DISPENSING CONTAINER

FIELD

The present application relates to a dispensing container and, more particularly, to a thin dispensing container that stores items and can be easily inserted into tight locations, for example, between a cigarette package wrapper and the paperboard of the cigarette package.

BACKGROUND

Packaging for confectionary items such as mints and gum come in many different styles. One such style of packaging is a thin, hard, rectangular shaped package that holds mints. The mints can be removed from the package from a single opening in a corner of the package. Even though this package can be placed between the wrapper and the paperboard of a cigarette pack, it is not targeted at smokers and there are at least three significant problems with using the mint package in such a way: 1) it is difficult for a user to slide the mint package between the wrapper and the paperboard of a cigarette pack due to the width of the mint package's bottom edge, 2) the height of the mint package restricts the removal of cigarettes from flip top cigarette packs requiring the mint package to be removed each time a cigarette is desired, and 3) the opening for removing mints does not easily allow removal while the mint package is in the cigarette pack requiring removal of the mint package from the cigarette package each time a mint is desired.

As a result, there is a need for a dispensing container for storing and dispensing small edible items, such as confectionary items, whereby the dispensing container can be slid easily between a wrapper and a cigarette package and whereby the items can be removed from the dispensing container and cigarettes can be removed from the cigarette package while the dispensing container is held between the wrapper and the cigarette package.

SUMMARY OF THE INVENTION

An aspect of the present application provides for a dispensing container. The dispensing container includes a body having a chamber for storing confectionary items and a door connected to the body and operable to dispense the confectionary items stored in the chamber, the body further including a top portion, the top portion including the door, and a bottom portion having a tapered edge adapted for inserting the body into a tight location.

Another aspect of the present application provides for a dispensing container. The dispensing container includes a body having a chamber for storing confectionary items and a door connected to the body and operable to dispense the confectionary items stored in the chamber, the body further including a top portion, the top portion having a top wall and including the door having a lower most portion, and a bottom portion including a tapered edge having a bottom wall, the tapered edge being adapted for inserting the body between a wrapper of a cigarette package and the cigarette package, wherein the door is positioned so that the confectionary items can be extracted from the chamber of the body while the body is inserted between the wrapper and the cigarette package.

A further aspect of the present application provides for a dispensing container. The dispensing container includes a body having a chamber for storing confectionary items and a door connected to the body and operable to dispense the confectionary items stored in the chamber, the body further including a top portion, the top portion including the door and a top wall, and a bottom portion including a tapered edge having a bottom wall, the tapered edge being adapted for inserting the body between a wrapper of a cigarette package and the cigarette package, wherein a length between the top wall and the bottom wall is a predetermined amount so that a flip top of a cigarette package can be opened and a cigarette can be extracted while the body is inserted between the wrapper and the cigarette package.

A still further aspect of the present application provides for a dispensing container. The dispensing container includes a body having a chamber for storing confectionary items, a hinge, and a door connected to the body by the hinge and operable to dispense the confectionary items stored in the chamber, the body further including a top portion, the top portion including the door having a lower most portion and a top wall, and a bottom portion including a tapered edge having a bottom wall, the tapered edge being adapted for inserting the body between a wrapper of a cigarette package and the cigarette package, wherein a length between the top wall and the bottom wall is a predetermined amount so that a flip top of the cigarette package can be opened and a cigarette can be extracted while the body is inserted between the wrapper and the cigarette package, and the door is positioned so that the confectionary items can be extracted from the chamber of the body while the body is inserted between the wrapper and the cigarette package.

An additional aspect of the present application provides for a dispensing container adapted to be used with a hard cigarette package having a flip top. The dispensing container includes a body having a chamber for storing confectionary items and adapted to be inserted between a wrapper of the cigarette package and the cigarette package, the body further including a top wall, a pair of side walls, a bottom wall, a front wall having a first tapered edge and a back wall having a second tapered edge, a hinge, and a door connected to the body by the hinge and operable to dispense the confectionary items stored in the chamber, the door having a lower most portion, wherein a length between the top wall and the bottom wall is a predetermined amount so that the flip top of the cigarette package can be opened and a cigarette can be extracted while the body is inserted between the wrapper of the cigarette package and the cigarette package, and the door is positioned so that the confectionary items can be extracted from the chamber of the body while the body is inserted between the wrapper and the cigarette package.

Another aspect of the present application provides for a dispensing container. The dispensing container includes a body having a chamber for storing confectionary items and a door connected to the body and operable to dispense the confectionary items stored in the chamber, the body further including a top portion, the top portion having a top wall and including the door having a lower most portion, and a bottom portion having a bottom wall, wherein the door is positioned so that the confectionary items can be extracted from the chamber of the body while the body is inserted between a wrapper of a cigarette package and the cigarette package.

A further aspect of the present application provides for a dispensing container. The dispensing container includes a body having a chamber for storing confectionary items and a door connected to the body and operable to dispense the confectionary items stored in the chamber, the body further including a top portion, the top portion including the door and a top wall, and a bottom portion having a bottom wall, wherein a length between the top wall and the bottom wall is a predetermined amount so that a flip top of a cigarette package can be opened and a cigarette can be extracted while the body is inserted between a wrapper of a cigarette package and the cigarette package.

A still further aspect of the present application provides for a dispensing container. The dispensing container includes a body having a chamber for storing confectionary items and a door connected to the body and operable to dispense the confectionary items stored in the chamber, the body further including a top portion, the top portion including the door having a lower most portion and a top wall, and a bottom portion including having a bottom wall, wherein a length between the top wall and the bottom wall is a predetermined amount so that a flip top of a cigarette package can be opened and a cigarette can be extracted while the body is inserted between a wrapper of the cigarette package and the cigarette package, and the door is positioned so that the confectionary items can be extracted from the chamber of the body while the body is inserted between the wrapper and the cigarette package.

DETAILED DESCRIPTION

Figure 1:
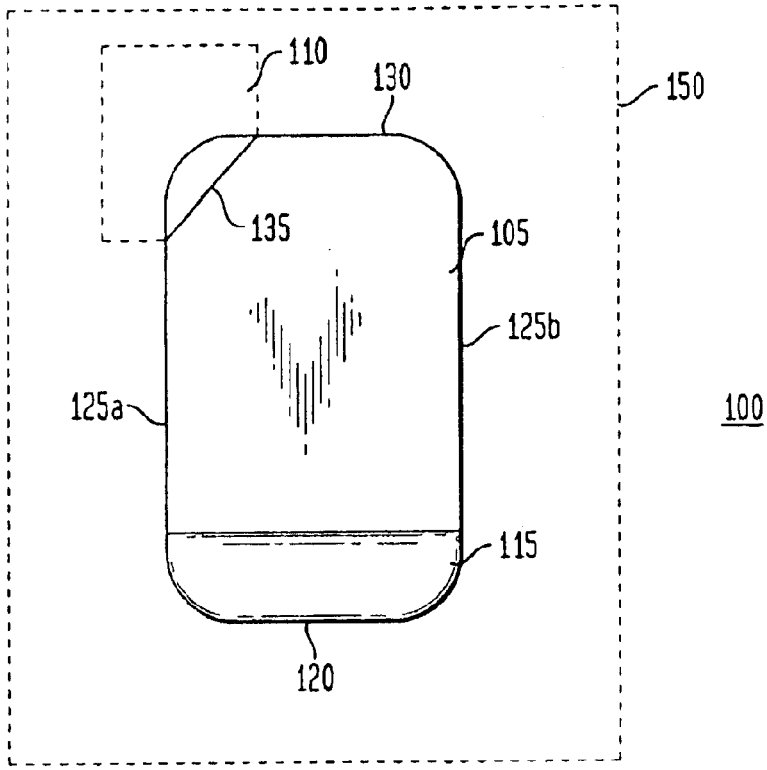
FIG. 1 illustrates a front view of an exemplary dispensing container of the present application.

FIG. 1 illustrates an exemplary dispensing container 100 of the present application. Dispensing container 100 includes body 150 and door 110 connected to body 150, for example, by hinge 135. As used in the present application, however, door is to be interpreted broader than a customary hinged door. The door can include any mechanism that is likely to keep items inside, but allows items to be extracted when desired, such as a slide, a flexible flap or a pressure sensitive slit or hole. Body 150 and door 110 can be made of any hard or semi-hard material, including translucent materials. Hinge 135 is operable to allow door 110 to open and close. Dispensing container 100 also includes chamber 505, shown in FIGS. 5 and 7, for storing small edible items, such as confectionary items, 705. Confectionary items can include, but are not limited to, mints, gum or candies. As will be appreciated by a person of ordinary skill in the art, body 150 can function as a chamber and, therefore, can contain the small edible items and the items can be extracted by using door 100.

Body 150 includes top wall 130, bottom wall 120, a pair of side walls 125*a*, 125*b*, front wall 105, back wall 205 and tapered edge 115. In an exemplary embodiment, door 110 is located on front wall 105 and in the top portion of body 150 and tapered edge 115 is symmetrically located on front wail 105 and back wall 205 in the bottom portion of body 150. In an alternative embodiment, tapered edge 115 can be more or less tapered on front wall 105 and/or back wall 205.

Figure 2:
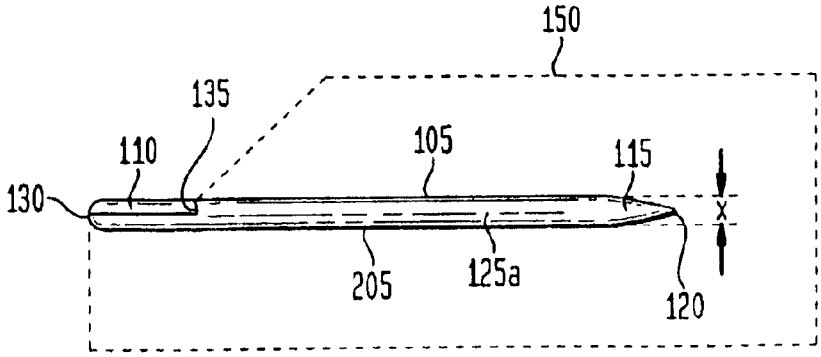
FIG. 2 illustrates a side view of an exemplary dispensing container of the present application.

FIG. 2 illustrates a side view of exemplary dispensing container 100 with door 110 closed. As can be seen in FIG. 2, tapered edge 115 is symmetrically located on front wall 105 and back wall 205 in the bottom portion of body 150. Tapered edge 115 tapers down to bottom wall 120. In addition, thickness x from front face 105 to back face 205 is approximately 6 mm. Thickness x can obviously be greater or less than 6 mm.

Figure 3A:
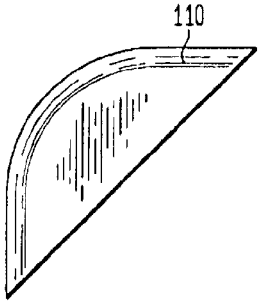
FIG. 3*a* illustrates an exemplary door of a dispensing container of the present application.
Figure 3B:
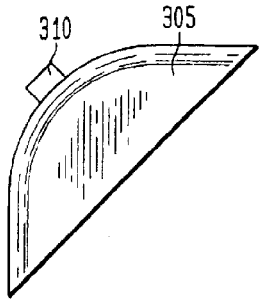
FIG. 3*b* illustrates another exemplary door of a dispensing container of the present application.
Figure 3C:
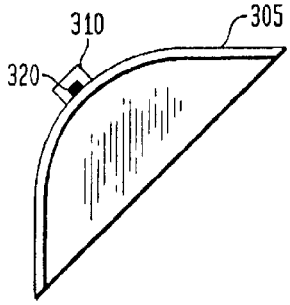
FIG. 3*c* illustrates a back side of the exemplary door shown in FIG. 3*b* of the present application.

FIGS. 3*a* and 3*b* depict door 110 shown in FIGS. 1 and 2 and door 305, respectively. As can be seen in FIG. 3*b*, door 305 includes tab 310 for assisting a user in opening and closing door 305 that can be attached to a body such as body 150 shown in FIG. 1. The shape, size and style of tab 310 is merely illustrative. Tab 310 and door 305 can be a unitary piece of material or separate pieces of material joined together. FIG. 3*c* illustrates a back side of exemplary door 305 shown in FIG. 3*b*. Door 305 includes catch 320 which is operable to engage with, for example, body 105 and keep door 305 closed when not being used to remove confectionary items 705. Door 110, door 305 and body 110 can utilize numerous other designs for keeping the respective door closed which are well known in the art. As opposed to having a tab, for example tab 310, a door can be devoid of a tab as shown in FIG. 3*a*. Door 110 and door 305 are designed to be used on a corner of dispensing container 100. A door, however, can be constructed and located in various other ways and positions to assist a user in opening and closing the respective door and is not limited to the embodiments described in the present application as the embodiments are merely exemplary.

Figure 4:
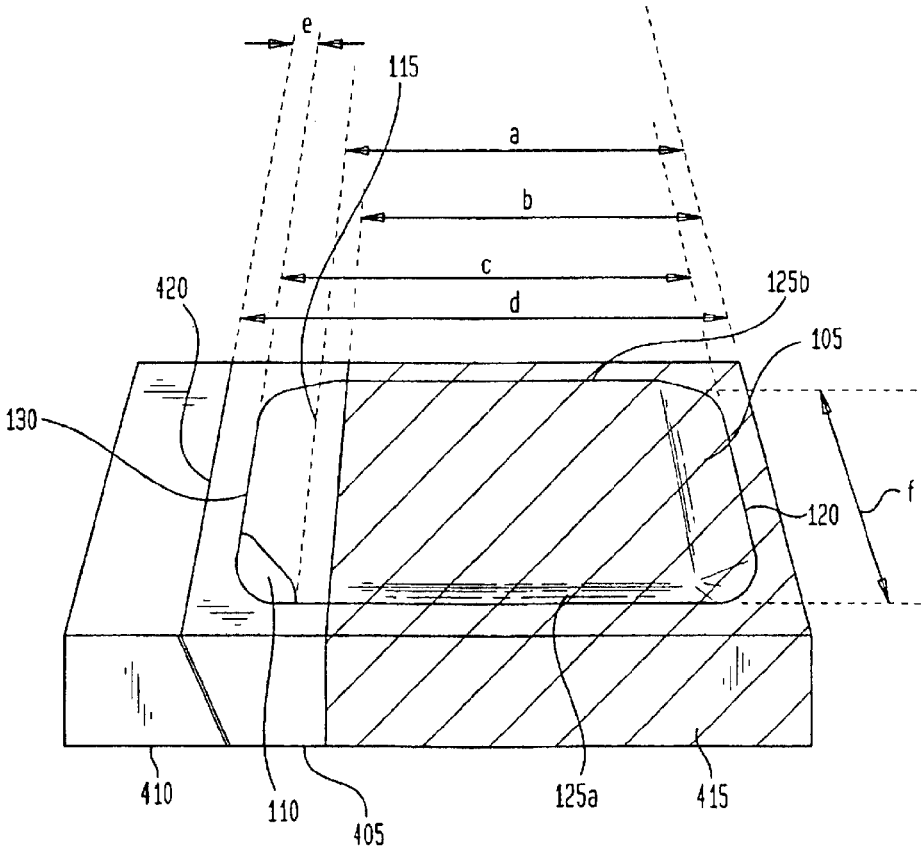
FIG. 4 illustrates an exemplary dispensing container inserted between a cigarette package wrapper and a cigarette package of the present application.
Figure 5:
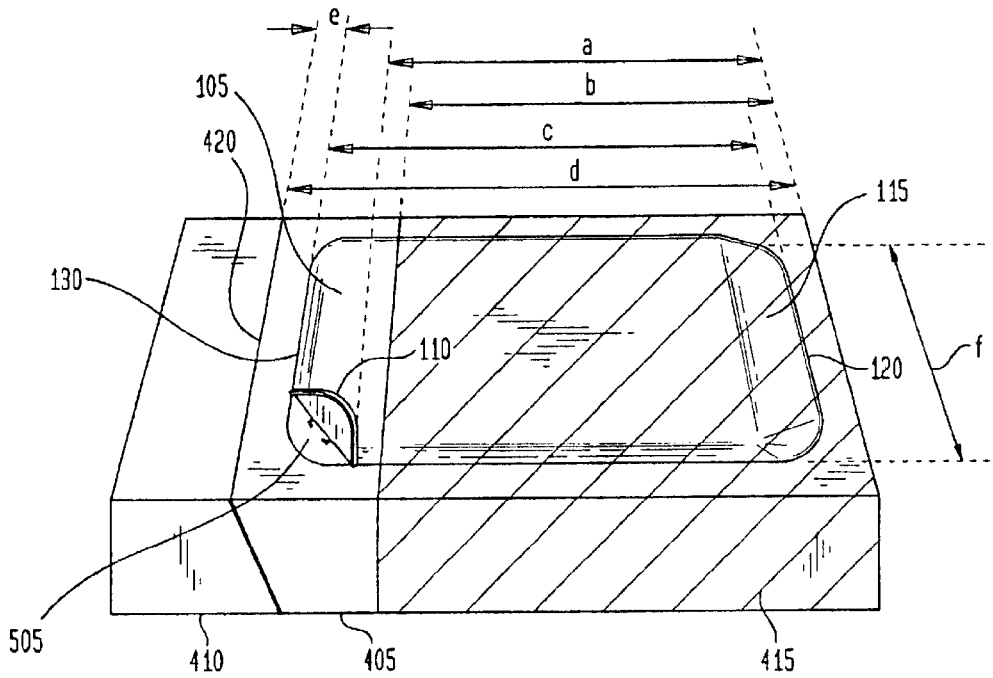
FIG. 5 illustrates an exemplary dispensing container inserted between a cigarette package wrapper and a cigarette package of the present application.
Figure 7:
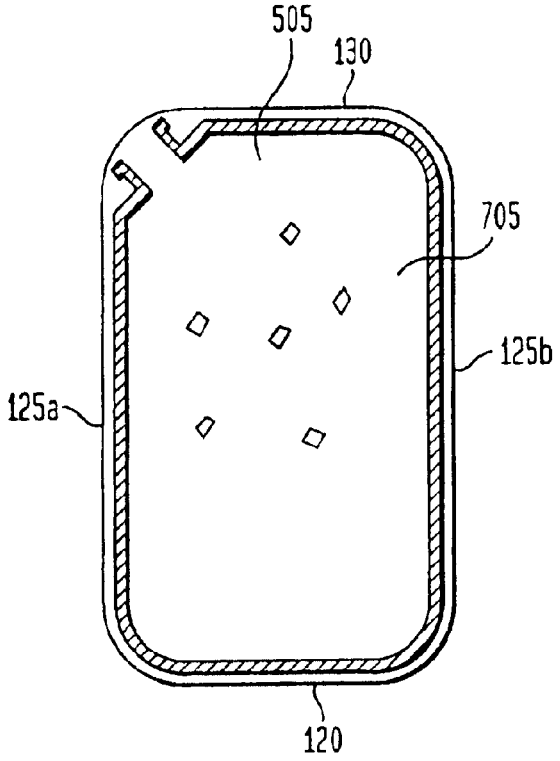
FIG. 7 illustrates an inside chamber of an exemplary dispensing container of the present application.

An exemplary use of dispensing container 100 is illustrated in FIG. 4. FIG. 4 shows dispensing container 100 inserted between wrapper 415 of flip top cigarette package 405 and the back paperboard of cigarette package 405. Wrapper 415 can be made of a variety of materials, for example, a flexible plastic. Cigarette package 405 is referred to in the art as a hard pack and includes flip top 410 connected to cigarette package 405 by hinge 420. Flip top 410 contains one or more cigarettes stored therein. As can be seen in FIG. 4, after dispensing container 100 is inserted under wrapper 415, door 110 remains outside wrapper 415. As a result, confectionary items 705 stored in chamber 505 of dispensing container 100, as shown in FIG. 7, can be extracted by a user without having to remove dispensing container 100 from between cigarette package 405 and wrapper 415. FIG. 5 illustrates door 100 opened while dispensing container 110 is inserted between wrapper 415 and cigarette package 405, whereby confectionary items 705, such as mints, can be retrieved from chamber 505.

Further, tapered edge 115 allows a user to more easily insert dispensing container 100 in a tight location, for example, between wrapper 415 and cigarette package 405. This is especially useful when cigarette package 405 is new and wrapper 415 is terse such that there is very little or no space at the top of wrapper 415 to insert anything. Due to the tapered edge 115, dispensing container 100, however, can be easily inserted into other tight locations, such as a tight pocket and wallet.

In an exemplary embodiment, the dimensions of dispensing container 100 are such that confectionary items 705 can be extracted from chamber 505 without having to remove dispensing container 100 from between cigarette package 405 and wrapper 415. Specifically, length a which is the distance from the bottom of cigarette package 405 to the lower most portion of door 110 is greater than or equal to length b which is the distance from the bottom of wrapper 415 to the top of wrapper 415 when the bottom of the wrapper 415 is in contact with the bottom of cigarette package 405, as shown in FIGS. 4 and 5. Length a is greater than or equal to length b even when bottom wall 120 is in contact with the bottom of wrapper 415. In an alternative embodiment, length a can be less than length b when bottom wall 120 is in contact with the bottom of wrapper 415 so that at least a portion of door 110 is covered by wrapper 415. As a result, a user can insert dispensing container 100 between wrapper 415 and cigarette package 405 only so far as to keep door 110 exposed for removing confectionary items 705. Wrapper 415 is sufficiently tight to hold dispensing container 100 at the appropriate location. In addition, cigarettes, can be removed from cigarette package 405 without removing dispensing container 100 by opening flip top 410 due to the dimensions of dispensing container 100 in relation to cigarette package 405.

Length c represents the distance from bottom wall 120 to top wall 130, length d represents the distance from the bottom of cigarette package 405 to hinge 420 and width f represents the distance from side wall 125*a* to side wall 125*b*. Width f is such that dispensing container 100 can fit within wrapper 415. In addition, thickness x of dispensing container 100, shown in FIG. 2, is such that dispensing container 100 can fit between a tightly fitted wrapper 415 on cigarette package 405.

Examples of the above lengths, width and thickness are length c can be approximately 64 mm, length a can be approximately 70 mm, length b can be approximately 54 mm, length d can be approximately 75 mm, width f can be approximately 48 mm and thickness x can be approximately 6 mm. As a result of the dimensions of dispensing container 100 in relation to cigarette package 405 and wrapper 415, confectionary items 705 can be extracted from chamber 505 without having to remove dispensing container 100 from between cigarette package 405 and wrapper 415 and without wrapper 415 obstructing door 110 from opening and closing. Obviously, dispensing container 100 can also be used between wrapper 415 and the front of cigarette package 405.

Cigarette package 405 can also be what is referred to in the art as a soft pack which does not have a flip top, a tall pack which may be soft or hard with a flip top, or a soft or hard wide pack.

As for a soft pack, a wrapper of the soft pack can extend to the top of the soft pack or close to the top or the wrapper may only extend a distance similar to wrapper 415 shown in FIG. 4. In the event that the wrapper extends the same distance as wrapper 415 shown in FIG. 4, dispensing container 110 functions the same as described above with reference to cigarette package 405. However, if the wrapper extends to the top of the soft pack, door 110 of dispensing container 100 may be covered by the wrapper when dispensing container 100 is fully inserted between the wrapper and the soft pack. Tapered edge 115 would still allow a user to more easily insert dispensing container 100 between the wrapper and soft pack. The user needs to slide dispensing container 100 out of the wrapper at least until door 110 is exposed and can be opened for removing confectionary items 705. Further, a user can insert dispensing container 100 between the wrapper and the soft pack only so far as to keep door 110 exposed for removing confectionary items 705. The wrapper of the soft pack is sufficiently tight to hold dispensing container 100 at the appropriate location. Obviously, the dimensions, such as length c, of dispensing container 100 can be altered for use with such a soft pack so that door 110 can be opened while dispensing container 100 is fully or nearly fully inserted between the wrapper and the soft pack. In such a case, dispensing container 100 may extend beyond the top of the soft pack.

Tall hard packs with a flip top and tall soft packs often have a wrapper that does not extend to the top of the respective pack, but often do have a wrapper longer than wrapper 415. As a result, when using dispensing container 100 with such tall packs, the wrapper may cover door 110 when dispensing container 100 is inserted too far. Therefore, a user can insert dispensing container 100 between the wrapper and the tall pack only so far as to keep door 110 exposed for removing confectionary items 705. The wrapper is sufficiently tight to hold dispensing container 100 at the appropriate location. In addition, tapered edge 115 would still allow a user to more easily insert dispensing container 100 between the wrapper and tall pack. As with the soft pack described above, the dimensions, such as length c, of dispensing container 100 can be altered for use with a tall pack so that door 110 can be opened while dispensing container 100 is inserted between the wrapper and the tall pack. Lastly, dispensing container 100 or a dispensing container with altered dimensions would still allow a user to remove cigarettes from a tall pack with a flip top without removing dispensing container 100 by opening the flip top due to the dimensions of the respective dispensing container in relation to the tall pack.

Figure 6:
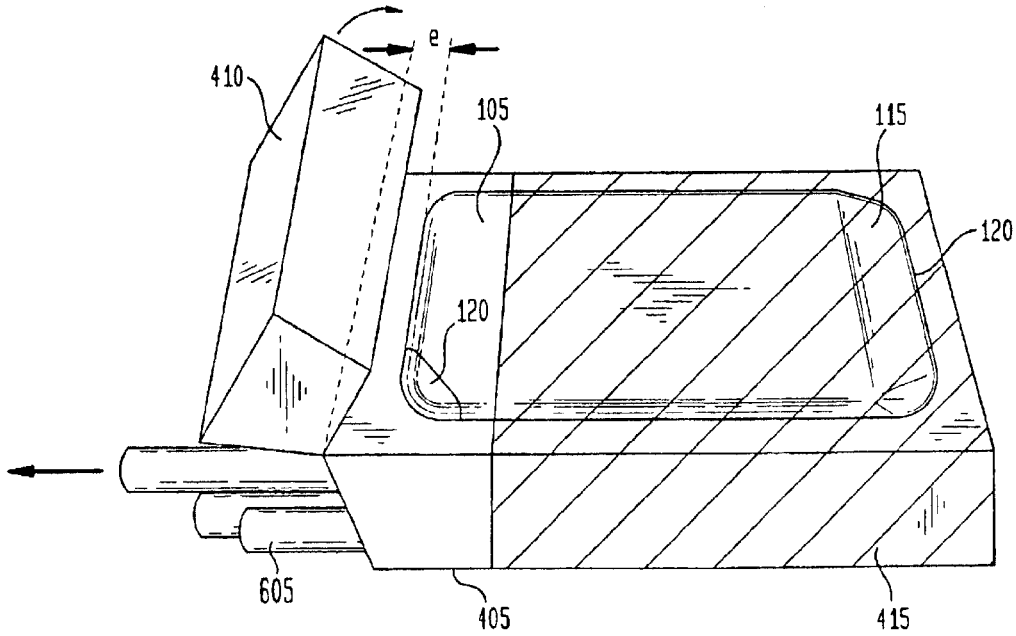
FIG. 6 illustrates an exemplary dispensing container inserted between a cigarette package wrapper and a cigarette package of the present application.

Similarly, FIG. 6 illustrates that items, such as cigarettes, can be removed from cigarette package 405 without removing dispensing container 100 by opening flip top 410 due to the dimensions of dispensing container 100 in relation to cigarette package 405. In particular, flip top 410 can be opened while dispensing container 100 is inserted between wrapper 415 and the back of cigarette package 405 at least because of distance e shown in FIGS. 4, 5 and 6. Distance e which is the distance from hinge 420 connecting flip top 410 to cigarette package 405 to top wall 130 of dispensing container 100 allows flip top 410 to open a sufficient amount so that each cigarette 605, for example, from a full package, can be removed without contacting flip top 410. For example, distance e can be in the range of 3 mm to 10 mm. In order for distance e to be appropriate, a distance between top wall 130 and bottom wall 120 is a predetermined amount so that flip top 410 of cigarette package 405 can be opened and one or more cigarettes can be extracted while body 150 is inserted between the wrapper 415 of cigarette package 405 and cigarette package 405.

Figure 8A:
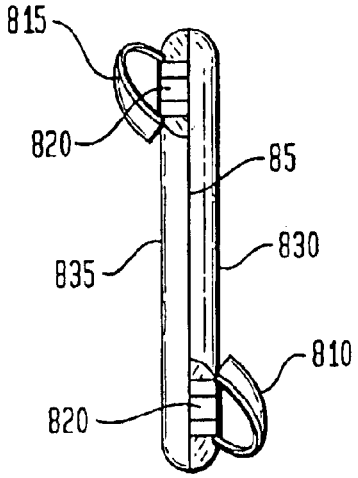
FIG. 8*a* illustrates a top view of an exemplary dispensing container having two doors.

FIG. 8*a* depicts a top view of another exemplary dispensing container 800 of the present application. Dispensing container 800 shown in FIG. 8*a* includes top wall 805, front wall 830, back wall 835, door 810, door 815 and chamber 820. As can be seen in FIG. 8, dispensing container 800 includes two doors 810, 815 on opposite sides 830, 835 of dispensing container 800. Depending on whether front wall 830 or back wall 835 is facing a user after being inserted between a cigarette package and a cigarette package wrapper, either door 810, 815 can be used to extract confectionary items 705 from chamber 820 without having to remove dispensing container 800. The use of two doors 810, 815 on opposite sides 830, 835 of dispensing container 800 prevents a user from inserting dispensing container 800 in a way that would impede the opening of door 810, 815 while inserted between the cigarette package and the wrapper.

Figure 8B:
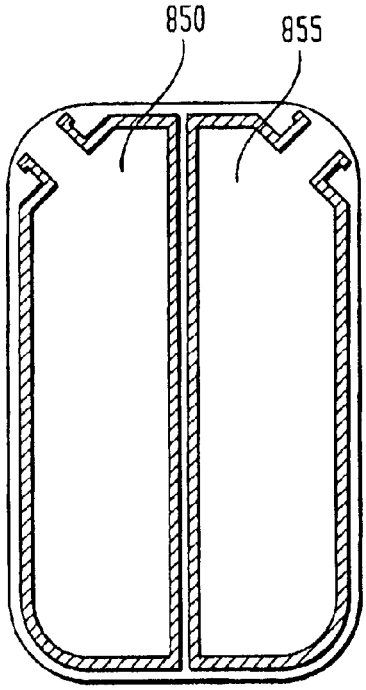
FIG. 8*b* illustrates two chambers of an exemplary dispensing container having two dispensing doors.

In alternative embodiments, doors 810, 815 can be arranged on dispensing container 800 in a variety of other ways. For example, both doors 810, 815 can be on front side 730 or back side 735 or one to six additional doors can be utilized so that three to all eight corners of dispensing container 800 have an opening to extract the same confectionary items 705. In a further alternative embodiment, each of a plurality of doors, such as doors 810, 815, can provide access to separate and divided chambers 850, 855 holding the same or different confectionary items, as shown in FIG. 8*b*. Additional chambers can be incorporated in a dispensing container with one or more separate doors providing access to each chamber.

The present application is not limited to using a dispensing container, such as dispensing container 100, with a cigarette package. Rather, the dimensions, such as length c, of dispensing container 100 can be altered for use with another type of package, for example, a cigar package, having a wrapper, so that one or more doors can be opened while dispensing container 100 is inserted between the wrapper and the package. Moreover, dispensing container can be inserted in a wallet, a business card holder, a pocket in a briefcase and any other slot that can hold something.

In addition, dispensing container 100 can be adapted to also function as a lighter or breath freshening sprayer or function solely as a lighter or breath freshening sprayer. FIGS. 9*a*, 9*b* and 10*a*, 10*b* illustrate lighter 900 and breath freshening sprayer 1000, respectively.

Figure 9A:
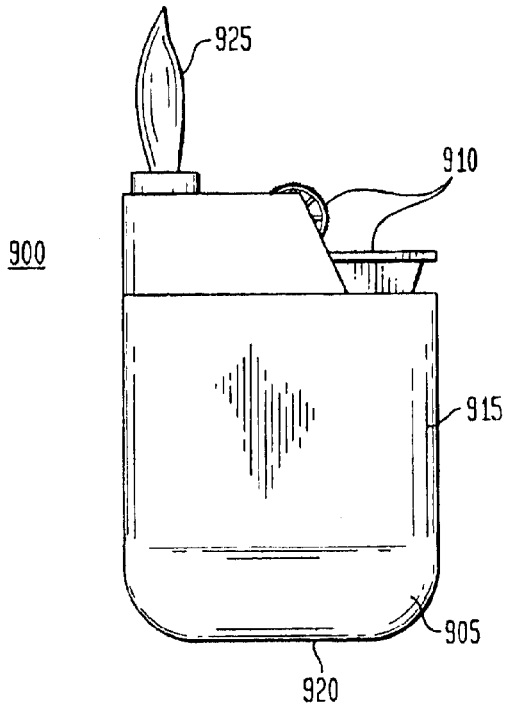
FIG. 9*a* illustrates an exemplary lighter of the present application.
Figure 9B:
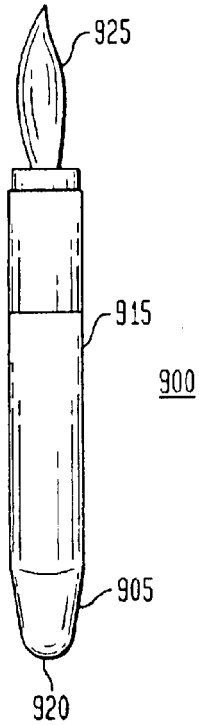
FIG. 9*b* illustrates a side view of the exemplary lighter shown in FIG. 9*a;*

As can be seen in FIG. 9*a*, lighter 900 includes body 915 and lighting mechanism 910 when operated causes flame 925. Body 915 includes tapered edge 905 and bottom wall 920. Due to tapered edge 905, a user can more easily insert lighter 900 between a wrapper of a cigarette pack and the cigarette pack. In addition, the dimension of lighter 900 are such that lighter 900 can fit between the wrapper of the cigarette pack and the cigarette pack and cigarettes can be removed from the cigarette package without removing lighter 900, for example, by opening a flip top of the cigarette package. FIG. 9*b* illustrates a side view of exemplary lighter 900. The dimensions of lighter 900 can be altered so that lighter 900 is adapted to be used with various different types of cigarette packages. Further, in an alternative embodiment, flame 925 can occur at a top portion of a front wall or a back wall of body 915 so that lighter 900 can be utilized, for example, to light cigarettes without removing lighter 900 from between the wrapper and the cigarette pack.

Figure 10A:
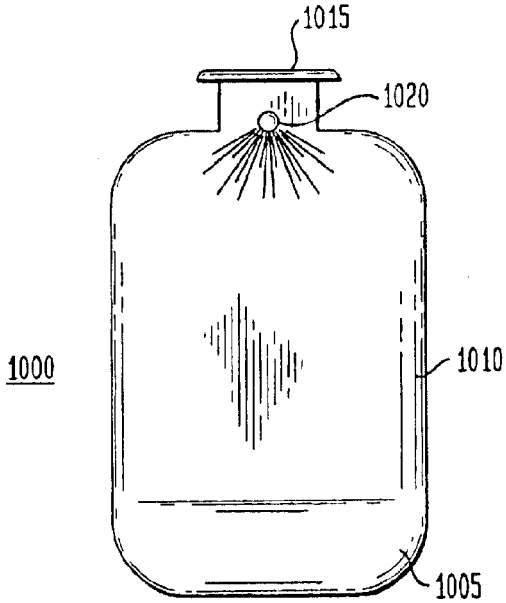
FIG. 10*a* illustrates an exemplary breath mint sprayer of the present application.
Figure 10B:
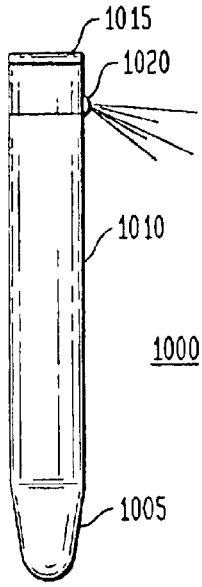
FIG. 10*b* illustrates a side view of the exemplary breath freshening sprayer shown in FIG. 10*a*.

FIG. 10*a* illustrates an exemplary breath freshening sprayer 1000. Breath freshening sprayer 1000 includes body 1010, depressing unit 1015 and hole 1020 through which a breath freshening mist can be extracted. Body 1010 includes tapered edge 1005. FIG. 10*b* illustrates a side view of the exemplary breath freshening sprayer 1000 shown in FIG. 10*a*. Similar to lighter 900 shown in FIGS. 9*a*, 9*b*, tapered edge 1005 allows a user to more easily insert breath freshening sprayer 1000 between a wrapper of a cigarette pack and the cigarette pack. In addition, the dimension of breath freshening sprayer 1000 are such that breath freshening sprayer 1000 can fit between the wrapper of the cigarette pack and the cigarette pack and cigarettes can be removed from the cigarette package without removing breath freshening sprayer 1000, for example, by opening a flip top of the cigarette package. The dimensions of breath freshening sprayer 1000 can be altered so that breath freshening sprayer 1000 is adapted to be used with various different types of cigarette packages. Further, if hole 1020 is located above the wrapper when inserted between the wrapper and the cigarette pack breath freshening mist can be extracted from hole 1020 without removing breath freshening sprayer 1000. Accordingly, hole 1020 is preferably located at a top portion of a front wall or a back wall of body 1010.

The embodiments described above are illustrative examples of the present invention and it should not be construed that the present invention is limited to these particular embodiments. Various changes and modifications may be effected by one skilled in the art without departing from the spirit or scope of the invention as defined in the appended claims.

What is claimed is:

1. An apparatus, comprising:

a cigarette package, the cigarette package being operable for storing at least one cigarette;

a wrapper, the wrapper encasing a portion of the cigarette package; and a dispensing container for residing between the cigarette package and the wrapper, the dispensing container including a body for storing confectionary items, the body having a top portion and a bottom portion, the bottom portion including a tapered edge, the tapered edge operable for inserting the body between the wrapper and the cigarette package, and a door connected to the top portion of the body and operable to dispense the confectionary items stored in the body while the body is fully inserted between the wrapper and the cigarette package.

2. The apparatus as set forth in claim 1, wherein a length between the lower most portion of the body and the lower most portion of the door is a predetermined amount so that the door can be opened and the confectionary items can be extracted from the body while the body is fully inserted between the wrapper and the cigarette package.

3. The apparatus as set forth in claim 1, wherein the cigarette package is constructed of a substantially rigid material and has a flip top.

4. The apparatus as set forth in claim 3, wherein a length between the upper most portion of the body or the door and the lower most portion of the body is a predetermined amount so that the flip top can be opened and the at least one cigarette can be extracted from the cigarette package while the body is fully inserted between the wrapper and the cigarette package.

5. The apparatus as set forth in claim 1, wherein the confectionary items are breath freshening products.

6. The apparatus as set forth in claim 1, wherein the confectionary items are chewing gum products.

7. The apparatus as set forth in claim 1, wherein the confectionary items are one of hard and soft candy products.

8. The apparatus as set forth in claim 1, wherein the body and the door are made of a translucent material.

9. The apparatus as set forth in claim 1, wherein the wrapper is constructed of a flexible plastic material.

10. The apparatus as set forth in claim 1, wherein the cigarette package is constructed of a substantially flexible material.

11. The apparatus as set forth in claim 1, wherein the height of the cigarette package is at least twice the width of the cigarette package.

12. The apparatus as set forth in claim 1, wherein the width of the cigarette package is greater than the height of the cigarette package.

13. The apparatus as set forth in claim 1, wherein the body includes a first side and a second side, and further comprising:

a second door, the door being located on the first side of the body and the second door being located on the second side of the body, each door operable to dispense the confectionary items stored in the body.

14. The apparatus as set forth in claim 1, wherein the body includes a first side and a second side, and further comprising:

a first chamber in the body for storing the confectionary items;

a second door; and a second chamber in the body, the door being located on the first side of the body and operable to dispense the confectionary items stored in the first chamber and the second door being located on the second side of the body and operable to dispense items stored in the second chamber.

15. The apparatus as set forth in claim 1, further comprising:

a hinge for connecting the door to the body.

16. An apparatus, comprising:

a cigarette package having a flip top, the cigarette package being operable for storing at least one cigarette;

a wrapper, the wrapper encasing a portion of the cigarette package; and a dispensing container for residing between the cigarette package and the wrapper, the dispensing container including a body for storing confectionary items, the body having a top portion and a bottom portion, the bottom portion including a tapered edge, the tapered edge operable for inserting the body between the wrapper and the cigarette package, and a door connected to the top portion of the body and operable to dispense the confectionary items stored in the body, a length between the lower most portion of the body and the lower most portion of the door being a predetermined amount so that the confectionary items can be extracted from the body while the body is fully inserted between the wrapper and the cigarette package.

17. The apparatus as set forth in claim 16, wherein the confectionary items are breath freshening products.

18. A The apparatus as set forth in claim 16, wherein the confectionary items are chewing gum products.

19. The apparatus as set forth in claim 16, wherein the confectionary items are one of hard and soft candy products.

20. The apparatus as set forth in claim 16, wherein the body and the door are made of a translucent material.

21. The apparatus as set forth in claim 16, wherein the wrapper is constructed of a flexible plastic material.

22. The apparatus as set forth in claim 16, further comprising:

a hinge for connecting the door to the body.

23. An apparatus, comprising:

a cigarette package having a flip top, the cigarette package being operable for storing at least one cigarette;

a wrapper, the wrapper encasing a portion of the cigarette package; and a dispensing container for residing between the cigarette package and the wrapper, the dispensing container including a body for storing confectionary items, the body having a top portion and a bottom portion, the bottom portion including a tapered edge, the tapered edge operable for inserting the body between the wrapper and the cigarette package, and a door connected to the top portion of the body and operable to dispense the confectionary items stored in the body, a length between the upper most portion of the body or the door and the lowermost portion of the body being a predetermined amount so that the flip top of the cigarette package can be opened and the at least one cigarette can be extracted from the cigarette package while the body is fully inserted between the wrapper and the cigarette package.

24. The apparatus as set forth in claim 23, wherein the confectionary items are breath freshening products.

25. The apparatus as set forth in claim 23, wherein the confectionary items are chewing gum products.

26. The apparatus as set forth in claim 23, wherein the confectionary items are one of hard and soft candy products.

27. The apparatus as set forth in claim 23, wherein the body and the door are made of a translucent material.

28. The apparatus as set forth in claim 23, wherein the wrapper is constructed of a flexible plastic material.

29. The apparatus as set forth in claim 23, further comprising;

a hinge for connecting the door to the body.

30. An apparatus, comprising:

a cigarette package having a flip top, the cigarette package being operable for storing at least one cigarette;

a wrapper, the wrapper encasing a portion of the cigarette package; and a dispensing container for residing between the cigarette package and the wrapper, the dispensing container including a body for storing confectionary items, the body having a top portion and a bottom portion, the bottom portion including a tapered edge, the tapered edge operable for inserting the body between the wrapper and the cigarette package, a hinge, and a door connected to the top portion of the body by the hinge and operable to dispense the confectionary items stared in the body, a length between the uppermost portion of the body or the door and the lower most portion of the body being a predetermined amount so that the flip top of the cigarette package can be opened and the at least one cigarette can be extracted from the cigarette package while the body is fully inserted between the wrapper and the cigarette package, and a length between the lower most portion of the body and the lower most portion of the door being a predetermined amount so that the confectionary items can be extracted from the body while the body is fully inserted between the wrapper and the cigarette package.

31. The apparatus as set forth in claim 30, wherein the confectionary items are breath freshening products.

32. The apparatus as set forth in claim 30, wherein the confectionary items are chewing gum products.

33. The apparatus as set forth in claim 30, wherein the confectionary items are one of hard and soft candy products.

34. The apparatus as set forth in claim 30, wherein the body and the door are made of a translucent material.

35. The apparatus as set forth in claim 30, wherein the wrapper is constructed of a flexible plastic material.

36. An apparatus, comprising:

a cigarette package having a flip top, the cigarette package being operable for storing at least one cigarette;

a wrapper, the wrapper encasing a portion of the cigarette package; and a dispensing container for residing between the cigarette package and the wrapper, the dispensing container including a body for storing confectionary items, the body operable for insertion between the wrapper and the cigarette package, the body defined by a top wall, a pair of side walls, a bottom wall, a front wall having a first lower tapered edge and a back wall having a second lower tapered edge;

a hinge; and a door connected to the body by the hinge and operable to dispense the confectionary items stored in the body, a length between the top wall and the bottom wall being a predetermined amount so that the flip top of the cigarette package can be opened and the at least one cigarette can be extracted from the cigarette package while the body is fully inserted between the wrapper and the cigarette package, and a length between the bottom wall and the lower most portion of the door being a predetermined amount so that the confectionary items can be extracted from the body while the body is fully inserted between the wrapper and the cigarette package.

37. An apparatus, comprising:

a cigarette package having a flip top, the cigarette package being operable for storing at least one cigarette;

a wrapper, the wrapper encasing a portion of the cigarette package; and a dispensing container for residing between the cigarette package and the wrapper, the dispensing container including a body for storing confectionary items, the body having a top portion and a bottom portion, and a door connected to the top portion of the body and operable to dispense the confectionary items stored in the body, a length between the upper most portion of the body or the door and the lower most portion of the body being a predetermined amount so that the flip top of the cigarette package can be opened and the at least one cigarette can be extracted from the cigarette package while the body is fully inserted between the wrapper and the cigarette package.

38. An apparatus, comprising:

a cigarette package having a flip top, the cigarette package being operable for storing at least one cigarette;

a wrapper, the wrapper encasing a portion of the cigarette package; and a dispensing container for residing between the cigarette package and the wrapper, the dispensing container including a body for storing confectionary items, the body having a top portion and a bottom portion, and a door connected to the top portion of the body and operable to dispense the confectionary items stored in the body, a length between the upper most portion of the body or the door and the lower most portion of the body being a predetermined amount so that the flip top of a cigarette package can be opened and the at least one cigarette can be extracted from the cigarette package while the body is fully inserted between the wrapper and the cigarette package, and a length between the lower most portion of the body and the lower most portion of the door being a predetermined amount so that the confectionary items can be extracted from the body while the body is fully inserted between the wrapper and the cigarette package.

* * * * *